US008955543B2

(12) United States Patent
Groesbeck et al.

(10) Patent No.: US 8,955,543 B2
(45) Date of Patent: Feb. 17, 2015

(54) LARGE BORE AUTO-FILL FLOAT EQUIPMENT

(75) Inventors: Brad Groesbeck, Houston, TX (US); Jeffrey Arcement, Houma, LA (US); John C. Jordan, Houston, TX (US); James G. Martens, Spring, TX (US)

(73) Assignee: Blackhawk Specialty Tools, LLC, Houston, TX (US)

( * ) Notice: Subject to any disclaimer, the term of this patent is extended or adjusted under 35 U.S.C. 154(b) by 732 days.

(21) Appl. No.: 13/068,916

(22) Filed: May 24, 2011

(65) Prior Publication Data

US 2011/0290344 A1 Dec. 1, 2011

Related U.S. Application Data

(60) Provisional application No. 61/347,615, filed on May 24, 2010.

(51) Int. Cl.

| | |
|---|---|
| ***F16K 15/18*** | (2006.01) |
| ***E21B 21/10*** | (2006.01) |
| *E21B 34/00* | (2006.01) |

(52) U.S. Cl.

CPC ..... *E21B 21/10* (2013.01); *E21B 2034/005* (2013.01)

USPC ..... 137/513; 137/68.15; 137/68.17; 137/614.11; 137/515; 166/325

(58) Field of Classification Search

USPC ..... 137/512, 513, 68.17, 68.15, 614.11, 137/515; 166/156, 325, 327

See application file for complete search history.

(56) References Cited

U.S. PATENT DOCUMENTS

| | | | | | |
|---|---|---|---|---|---|
| 2,768,695 | A | * | 10/1956 | Althouse, Jr. et al. | 166/327 |
| 3,011,559 | A | * | 12/1961 | Muse et al. | 166/325 |
| 3,072,145 | A | * | 1/1963 | Nelson | 137/846 |
| 3,275,080 | A | * | 9/1966 | Nelson et al. | 166/325 |
| 3,292,707 | A | * | 12/1966 | Nelson et al. | 166/325 |
| 4,154,303 | A | | 5/1979 | Fournier | |
| 4,687,019 | A | * | 8/1987 | Mayfield | 137/375 |
| 4,729,432 | A | | 3/1988 | Helms | |
| 6,401,824 | B1 | * | 6/2002 | Musselwhite et al. | 166/327 |
| 6,547,007 | B2 | * | 4/2003 | Szarka et al. | 166/317 |
| 6,679,336 | B2 | * | 1/2004 | Musselwhite et al. | 166/386 |
| 6,684,957 | B2 | * | 2/2004 | Allamon | 166/332.8 |
| 6,712,145 | B2 | * | 3/2004 | Allamon | 166/327 |
| 6,725,935 | B2 | * | 4/2004 | Szarka et al. | 166/318 |
| 6,745,723 | B1 | * | 6/2004 | Hicks et al. | 122/14.31 |
| 2002/0000318 | A1 | | 1/2002 | Allamon et al. | |
| 2002/0033262 | A1 | | 3/2002 | Musselwhite et al. | |
| 2003/0047314 | A1 | | 3/2003 | Allamon | |

(Continued)

OTHER PUBLICATIONS

PCT International Search Report dated Sep. 15, 2011.

*Primary Examiner* — William McCalister
(74) *Attorney, Agent, or Firm* — Ted M. Anthony

(57) ABSTRACT

An auto-fill type float collar assembly is provided. The float collar assembly of the present invention has at least one curved flapper-style valve, preferably constructed of composite, non-metallic material. Each flapper of the present invention has a substantially 90° range of motion, and is closed via a torsion spring. Each flapper is held in the open (or "auto-fill"), position via an external shifting mechanism passing around, rather than through, the central flow bore of the assembly. A floatable actuation ball can be run with the tool, or pumped downhole, in order to selectively actuate the assembly and close the flappers when desired.

14 Claims, 13 Drawing Sheets

(56) References Cited

U.S. PATENT DOCUMENTS

2003/0164191 A1* 9/2003 Lonardi et al. ..... 137/512
2005/0263190 A1* 12/2005 Hammond et al. ..... 137/512
2006/0162939 A1* 7/2006 Vick et al. ..... 166/386

* cited by examiner

LARGE BORE AUTO-FILL FLOAT EQUIPMENT

CROSS REFERENCES TO RELATED APPLICATION

Priority of U.S. provisional patent application Ser. No. 61/347,615 filed May 24, 2010, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a large bore float assembly. More particularly, the present invention pertains to a large bore float assembly having at least one flapper valve. More particularly still, the present invention pertains to a float assembly having non-metallic valves and other components, yet providing a greater pressure rating than conventional float assemblies.

2. Brief Description of the Prior Art

Drilling of an oil or gas well is frequently accomplished using a surface drilling rig and tubular drill pipe. When installing drill pipe (or other tubular goods) into a well, such pipe is typically inserted into a wellbore in a number of sections of roughly equal length called "joints". As the pipe penetrates deeper into a well, additional joints of pipe must be added to the ever lengthening "drill string" at the drilling rig. As such, a typical drill string comprises a plurality of sections or joints of pipe, each of which has an internal, longitudinally extending bore.

After a well is drilled to a desired depth, relatively large diameter pipe known as casing is typically installed and cemented in place within the wellbore. Cementing is performed by pumping a predetermined volume of cement slurry into the well using high-pressure pumps. The cement slurry is typically pumped down the inner bore of the casing, out the distal end of the casing, and back up around the outer surface of the casing. After the predetermined volume of cement is pumped, a plug or wiper assembly is typically pumped down the inner bore of the casing using drilling mud or other fluid in order to fully displace the cement from the inner bore of the casing. In this manner, the cement slurry leaves the inner bore of the casing and enters the annular space existing between the outer surface of the casing and the inner surface of the wellbore. As such cement hardens, it should beneficially secure the casing in place and form a seal to prevent fluid flow along the outer surface of the casing.

In many conventional cementing operations, an apparatus known as a float collar or float assembly is frequently utilized at or near the bottom (distal) end of the casing string. In most cases, the float assembly comprises a short length of casing or other tubular housing fitted with a check valve assembly, such as a flapper-valve, spring-loaded ball valve or other type of closing mechanism. The check-valve assembly permits the cement slurry to flow out the distal end of the casing, but prevents back-flow of the heavier cement slurry into the inner bore of the casing when pumping stops. Without such a float collar, the heavy cement slurry pumped into the annular space around the outside of the casing can U-tube or reverse flow back into the inner bore of the casing, which can result in a very undesirable situation.

Auto-fill float systems comprise specialized float collar assemblies that have been long known and widely used in the oil and gas industry. Generally, auto-fill float systems consist of float assemblies with one or more flapper-style valves run into a wellbore in an open position, such that wellbore fluids can flow bi-directionally through the assembly. When desired, said valves can be selectively closed via actuation mechanism(s); such activation mechanisms can include, for example, pressure and/or flow rate increases through the casing string. One common actuation mechanism involves insertion of a tubular member or sleeve through the valve body(ies) in order to hold the flapper(s) open. When desired, the tubular member can be selectively expelled from the assembly via a drop ball or other item; with the sleeve out of the way, the valve(s) are permitted to close.

As with virtually any float assembly, after cement slurry has been pumped and set, the float assembly must frequently be drilled out, typically with a PDC or roller-cone type bit. As such, the need for constructing float collar assemblies from drillable materials—such as composite material—is paramount. While composite valve bodies and flappers have existed for some time, both ferrous and non-ferrous metallic components continue to be used in the form of shear pins, hinge pins, and valve springs. Additionally, existing auto-fill systems have limited to no capability to adjust the activation variables such as, for example, deactivation pressure and/or flow rate. Such considerations highlight the need for improvement over existing prior art float assemblies.

Further, although float assemblies have been known in the art for some time, many have relatively small internal flow bores. As a result, pieces of rock or debris including, without limitation, debris suspended within the cement slurry can become lodged in the inner bore of the float assembly, thereby impeding progress of cementing operations and creating an unsafe condition. Further, problems exist with many existing prior art float valve assemblies, in terms of both actuation and the ability to withstand pressure loading.

Thus, there is a need for a durable, easily drillable, large-bore float assembly having at least one reliable, high-pressure valve assembly that can withstand significant wellbore pressures.

SUMMARY OF THE PRESENT INVENTION

In the preferred embodiment, the present invention comprises an "auto-fill" type float assembly having at least one composite, curved flapper valve for auto-filling a casing or liner string during oil and gas tubular running and cementing operations.

Considered broadly, the present invention comprises an auto-fill type float assembly having a central flow bore extending longitudinally therethrough. The float assembly of the present invention compromises two or more curved composite flapper-style valves. Each of said flappers of the present invention have a substantially 90° range of motion, and are closed via a torsion spring. Although said torsion spring can have many different embodiments, in the preferred embodiment said spring is made of composite material and is disposed around the circumference of the valve body. Each flapper is connected to the valve body via a composite hinge pin. Said flappers are held in the open (or "auto-fill"), position via an external shifting mechanism that does not require any obstruction or restriction through the central flow bore of any valve assembly.

In the preferred embodiment, the valve mechanism of the present invention is selectively actuated using a floatable ball (such as, for example, a ball constructed of phenolic material) that can beneficially engage against a corresponding ball seat member positioned below said valves. When flow rate is established through the system, the ball is pumped downward and becomes seated on said seat member forming a flow restriction within the central flow bore of said assembly.

Fluid pressure can then be increased above said seated ball. At a predetermined, specified pressure, at least one composite pin will shear, thereby allowing said ball seat member to shift downward, away from the valves. This event actuates the mechanism holding the flappers open, thereby allowing said valves to close. As pressure continues to increase above the ball, the collets of the ball seat member spread apart, allowing the ball to pass through said opened collets, and be expelled from the assembly into the wellbore below thereby removing the restriction from the central flow bore of the assembly. The colletted ball seat member permits changing of both the number of composite shear pins (thereby permitting adjustment of the activation pressure) and flow port size (thereby permitting adjustment of the activation flow rate) of the system.

According to one particularly advantageous embodiment of the present invention, the flapper and valve bodies are manufactured from high-temperature resins compression molded around a carbon- or glass-reinforced framework for added strength. The curved profile of each flapper allows the largest-possible inner diameter (ID) to be maintained when the valve is in the open position, resulting in higher auto-fill flow rates and maximum debris tolerance through the central flow bore of the assembly.

In the preferred embodiment, the valve springs of the present invention comprise carbon- or glass-reinforced single torsion-type springs. The hinge pins and deactivation mechanism components are beneficially manufactured of carbon- or glass-reinforced rods for high tensile and shear strength. The colletted ball seat is manufactured as a high-temperature mandrel-wrapped reinforced composite. The shear pins are ultrafine-grain graphite or uniform-resin composite. The drop ball is a low-density phenolic, which floats in most wellbore fluids, keeping the ball away from the ball seat until activation is required thereby reducing the likelihood of packing-off the central flow bore of the assembly with cuttings or other wellbore debris. The system further incorporates a ball retainer which can be removed to allow the ball to be dropped or to float in the casing/liner as needed.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

DETAILED DESCRIPTION OF A PREFERRED EMBODIMENT OF THE INVENTION

Figure 1:
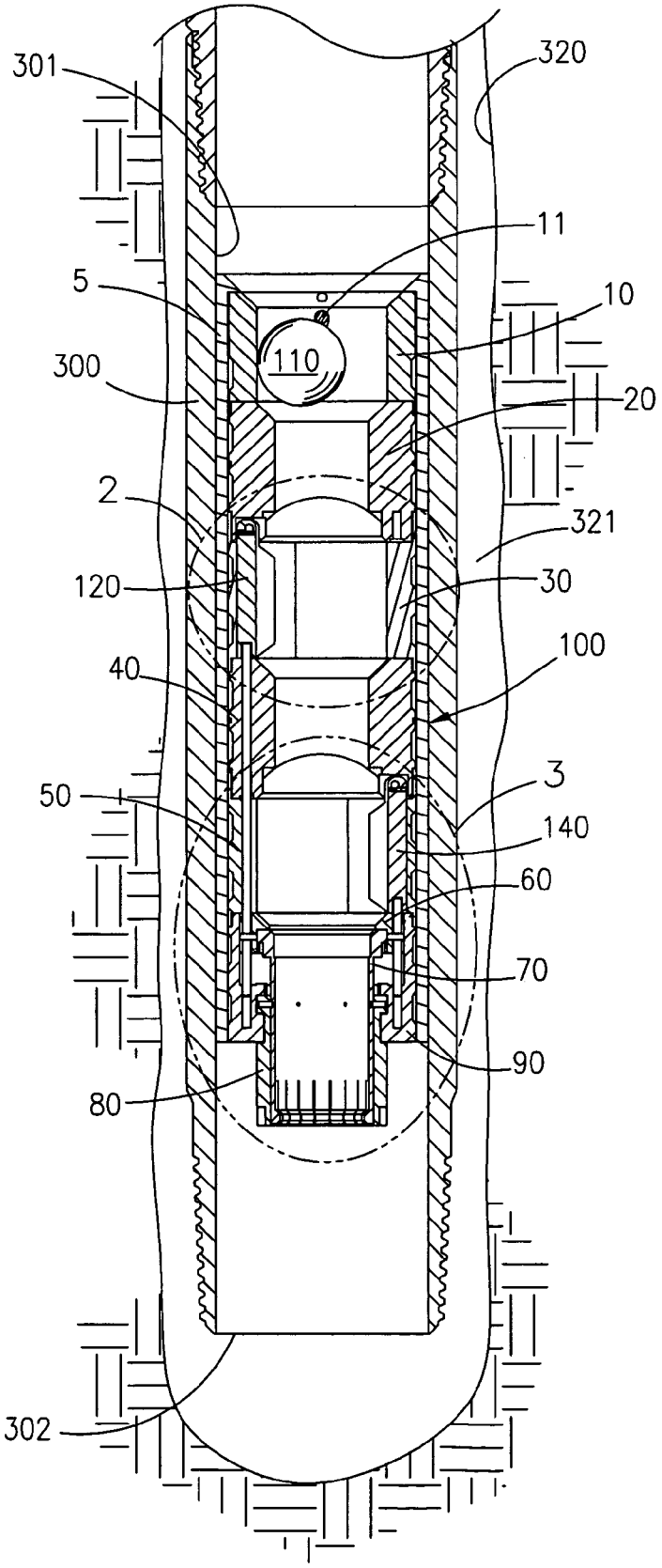
FIG. 1 depicts a side sectional view of the float assembly of the present invention installed in a wellbore with two flapper valves in a fully opened position.

FIG. 1 depicts a side sectional view of "auto-fill" type float assembly 100 of the present invention installed within a wellbore 320 which extends into the earth's crust. As depicted in FIG. 1, float assembly 100 is installed near the bottom (distal) end 302 of casing string 300 which has a central flow bore 301. Generally, float assembly 100 of the present invention permits cement slurry to flow down central flow bore 301 and out the open distal end 302 of casing 300 and into annular space 321 formed between wellbore 320 and the external surface of casing 300. Float assembly 100 permits cement slurry to flow out of distal end 302 of casing 300, while preventing back-flow of such heavy cement slurry into central flow bore 301 of casing 300 when pumping ceases. Without float assembly 100, relatively heavy cement slurry pumped into annular space 321 can "U-tube" or reverse flow back into central flow bore 301 of casing 300.

As set forth in greater detail below, float assembly 100 of the present invention can be run into wellbore 320 on casing string 300 in an open position, such that wellbore fluids can pass bi-directionally through said float collar assembly 100. Because of the large, unrestricted internal diameter of said float collar assembly 100 when said assembly 100 is in said open position, higher auto-filling flow rates and maximum debris tolerance through said float assembly 100 are achieved. Accordingly, because float assembly 100 of the present invention does not exhibit the same restrictions as conventional float assemblies, less fluid (surge) pressure is exerted on wellbore 320 and any potentially-sensitive formations present in said wellbore 320 when a casing string equipped with float assembly 100 is lowered into said wellbore.

Figure 12:
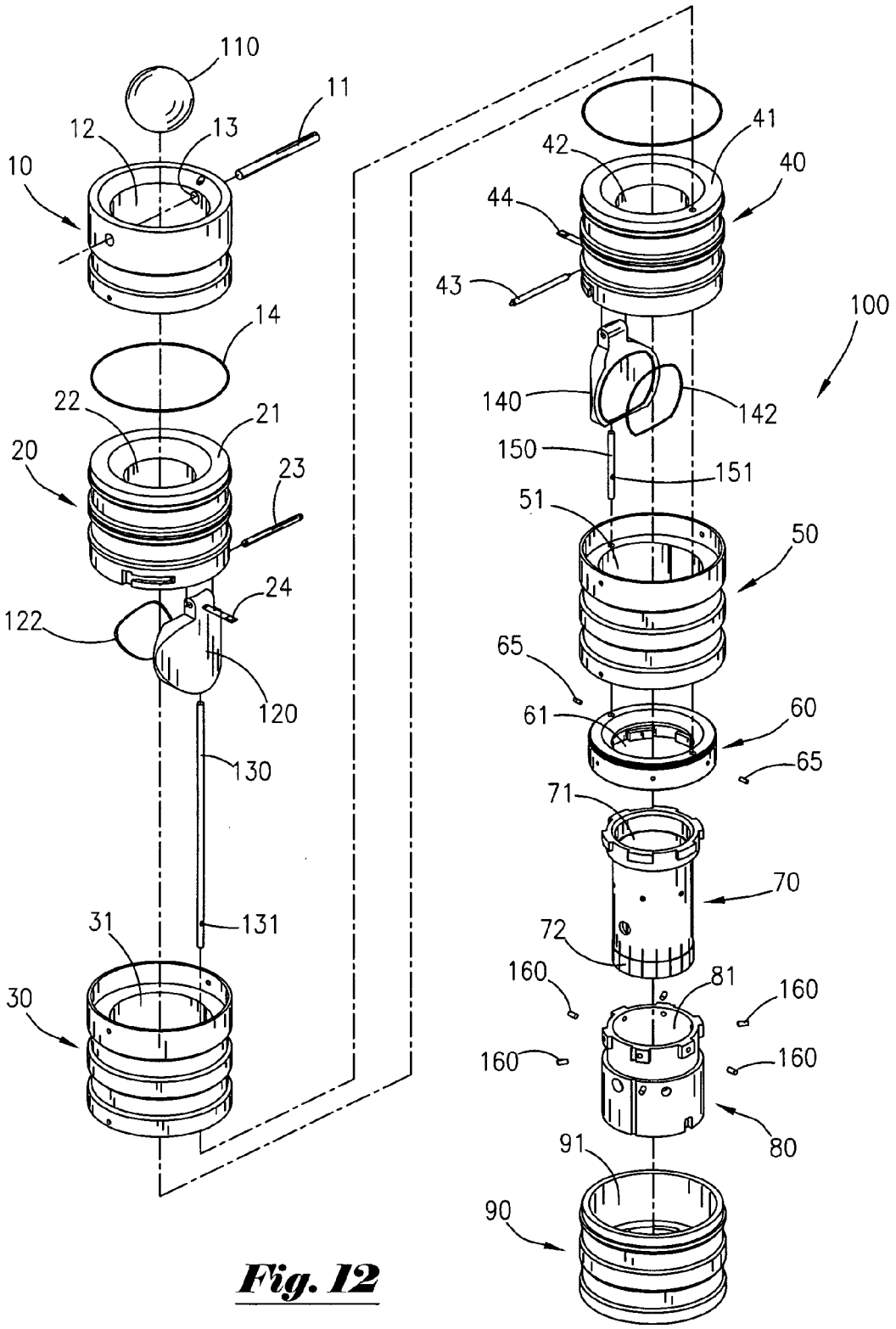
FIG. 12 depicts an exploded perspective view of the float assembly of the present invention.

Referring briefly to FIG. 12, which depicts an exploded view of float assembly 100, said float assembly 100 generally comprises ball retaining sub 10, upper valve assembly 20, upper spacer member 30, lower valve assembly 40, lower spacer member 50, collar member 60, moveable ball seat member 70, retaining sleeve 80 and bottom housing 90.

Referring back to FIG. 1, in the preferred embodiment of the present invention, ball retaining sub 10 is connected to upper valve assembly 20, which is in turn connected to upper spacer member 30. Lower valve assembly 40 is connected below upper spacer member 30, while lower spacer member 50 is connected below said lower valve assembly 40. Collar member 60 is received around the outer surface of ball seat member 70. Ball seat member 70 is slidably disposed within retaining sleeve 80 and bottom housing 90. Each of the aforementioned elements contain a central flow bore; said flow bores are aligned and collectively form a central flow bore extending substantially through said float assembly 100 along its longitudinal axis.

In the preferred embodiment of the present invention, retaining sub 10, upper valve assembly 20, upper spacer member 30, lower valve assembly 40, lower spacer member 50, and bottom housing 90 are concentrically disposed within external sleeve member 5; all of said components are further received within casing string 300 near distal end 302. Further, ball retaining sub 10, upper valve assembly 20, upper spacer member 30, lower valve assembly 40, lower spacer member 50, collar member 60, ball seat member 70, retaining sleeve 80 and bottom housing 90 are beneficially modular in design, such that any of said components can be quickly and easily removed from said assembly, and repaired and/or replaced, thereby allowing for greater operational flexibility.

Still referring to FIG. 1, float assembly 100 of the present invention comprises at least two composite flapper-style valve assemblies; in the embodiment depicted in FIG. 1, upper valve assembly 20 has curved upper flapper 120, while lower valve assembly 40 has curved lower flapper 140. Each of said curved flappers 120 and 140 of the present invention have a range of motion of approximately 90°, and each are biased in a closed position using a torsion spring as set forth in greater detail below. In the preferred embodiment, said flappers 120 and 140 are mounted with 180 degree phasing relative to one another; put another way, one flapper is hingeably mounted to open against one side of float assembly 100, while the other flapper is hingeably mounted to open against an opposing side (that is, 180 degrees offset) of said float assembly 100.

As a result of this configuration of flappers 120 and 140, at least one flapper will always be on the lower side of wellbore 320 when float assembly 100 of the present invention is used in horizontal or directional well (that is, a well that is deviated from a vertical path). Further, the configuration of the present invention permits independent pressure testing of the valve assemblies of the present invention, which provides significant safety improvement over existing prior art float assemblies.

As depicted in FIG. 1, actuation ball 110 is disposed within ball retaining sub 10. In the preferred embodiment, actuation ball 110 is constructed of low-density material (such as, for example, a phenolic material), which permits said actuation ball 110 to float in wellbore fluids, thus keeping said ball 110 from falling through the tool and prematurely actuating float assembly 100 when such actuation is not desired. Further, said actuating ball 110 is prevented from floating out of float assembly 100 and is held within ball retaining sub 10 using optional removable ball elongate retaining pin 11.

Conventional float collar assemblies typically employ an actuating ball that is retained in a substantially central location within the flow bore of each such assembly. However, positioning an actuation ball in this manner significantly restricts the cross-sectional flow area through a float assembly and, as a result, the ability of solids or other larger materials to pass through said central flow bore. By contrast, actuating ball 110 of the present invention remains positioned offset from the center of said central flow bore of ball retaining sub 10 because elongate retaining pin 11 substantially bisects the cross sectional area of said ball retaining sub. As a result of this positioning of actuating ball 110, a larger area of the central flow bore of ball retaining sub 10 (and float assembly 100) remains unobstructed, thereby permitting larger solids and/or debris to flow past said ball 110 than conventional prior art assemblies 100.

Figure 2:
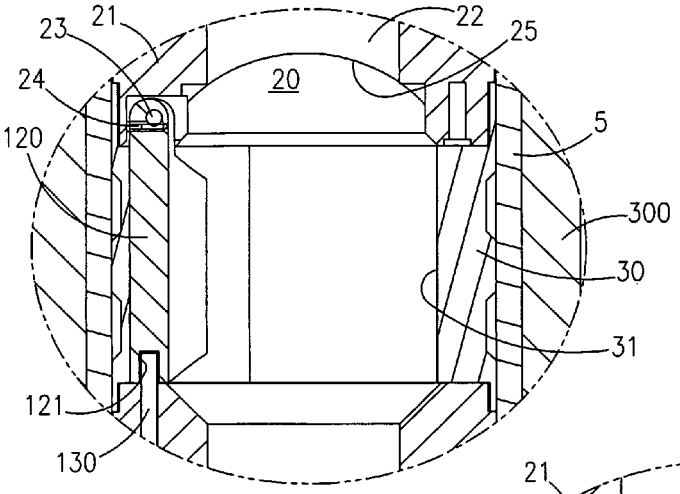
FIG. 2 depicts a detailed view of a highlighted section of the float assembly of the present invention depicted in FIG. 1 with the upper flapper in the full open position.

FIG. 2 depicts a detailed view of highlighted area "2" of float assembly 100 of the present invention depicted in FIG. 1. Upper valve assembly 20 comprises upper valve housing 21 having central flow bore 22 extending therethrough. Upper valve assembly 20 is concentrically disposed within external sleeve 5, which is in turn concentrically disposed within central bore 301 of casing string 300. Upper flapper 120 is hingeably connected to upper valve housing 21 using upper hinge pin 23. Torsion spring 24 acts to bias upper flapper 120 toward the closed position (that is, a position in which flapper 120 rotates about upper hinge pin 23 and seals central flow bore 22 of upper valve housing 21 against upward fluid pressure from below by engaging against upper valve seat 25). However, as depicted in FIG. 2, upper locking rod 130 is slidably received within a recess 121 in upper flapper 120. Said upper locking rod 130 acts to resist the forces applied to upper flapper 120 by torsion spring 24, and thereby prevents upper flapper 120 from rotating about upper hinge pin 23 and moving into central flow bore 22 of upper valve housing 21. As depicted in FIG. 2, in this position upper flapper 120 is held in an open position against a side wall of upper spacer member 30.

Figure 3:
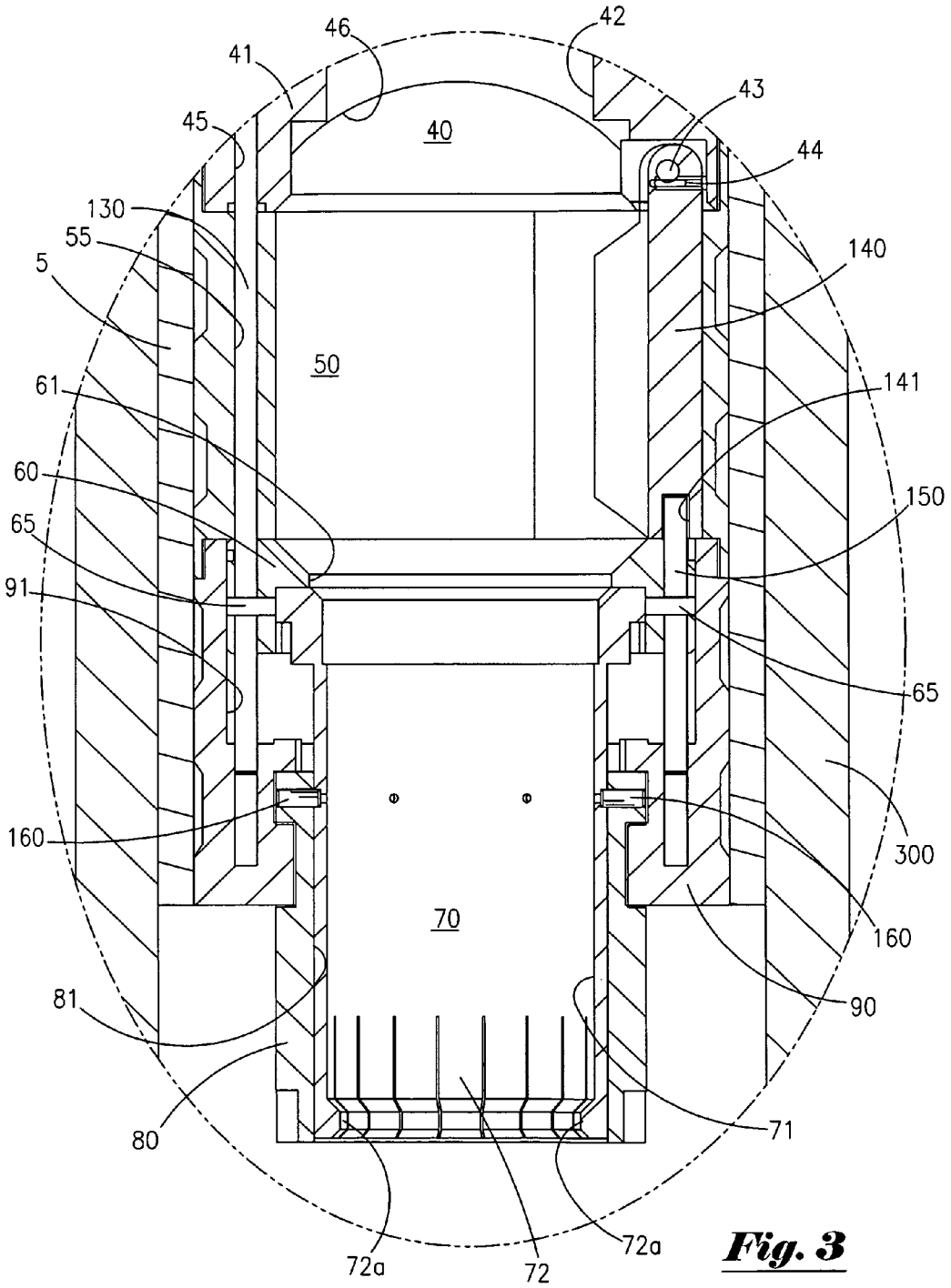
FIG. 3 depicts a detailed view of a highlighted section of the float assembly of the present invention depicted in FIG. 1 with the lower flapper in the full open position.

FIG. 3 depicts a detailed view of a highlighted section of float assembly 100 of the present invention depicted in FIG. 1 with lower flapper 140 in the full open position. Lower valve assembly 40 comprises upper valve housing 41 having central flow bore 42 extending therethrough. Lower valve assembly 40 is concentrically disposed within external sleeve 5, which is in turn concentrically disposed within casing string 300. Lower flapper 140 is pivotally connected to lower valve housing 41 using lower hinge pin 43. Torsion spring 44 acts to bias lower flapper 140 toward the closed position (that is, a position in which flapper 140 rotates about lower hinge pin 43 and seals central flow bore 42 of lower valve housing 41 against upward pressure from below by engaging against lower flapper seat 46). However, as depicted in FIG. 3, lower locking rod 150 is slidably received within recess 141 in lower flapper 140. Said lower locking rod 150 acts to resist the forces applied to lower flapper 140 by torsion spring 44, and thereby prevents lower flapper 140 from rotating about lower hinge pin 43 and moving into central flow bore 42 of lower valve housing 41. In this position, lower flapper 140 is held in an open position against a side wall of lower spacer member 50.

Still referring FIG. 3, lower spacer member 50 is connected to the base of lower valve assembly 40, while bottom housing 90 is connected to the base of said lower spacer member 50. Bottom housing 90 has central bore 91 extending therethrough. Retaining sleeve 80, having central bore 81, is connected to bottom housing 90. Collar member 60 has central bore 61 extending therethrough, and is slidably received within central bore 91 of bottom housing 90. Ball seat member 70 having central bore 71 is connected to collar member 60, and is concentrically and slidably received within central bore 81 of retaining member 80.

As shown in the configuration depicted in FIG. 3, ball seat member 70 is secured against axial movement within central bore 81 of retaining sleeve 80 using at least one shear pin 160. Ball seat member 70 has a plurality of collets 72 disposed at its lower end. Said collets 72 have dogs 72*a* that extend into central bore 71 of ball seat member 70, and cooperatively act to form a "seat" by restricting the internal diameter of said central bore 71.

Upper locking rod 130 and lower locking rod 150 are connected to collar member 60 using transverse rod retaining pins 65. In the preferred embodiment, said rod retaining pins 65 extend through aligned transverse bores in collar member 60 and each of said upper and lower locking rods 130 and 150. Upper locking rod 130 is slidably received within aligned rod bores 45 and 55 of lower valve assembly 40 and lower spacer member 50, respectively. Said rod bores 45 and 55 are substantially parallel to the longitudinal axes of central flow bore 43 of lower valve assembly 40 and central bore of lower spacer member 50.

The upper end of lower locking rod 150 is slidably received within recess 141 in lower flapper 140. Said lower locking rod 150 acts to resist the forces applied to lower flapper 140 by torsion spring 44, and thereby prevents lower flapper 140 from rotating about lower hinge pin 43 and moving into central flow bore 42 of lower valve housing 41. In this position, lower flapper 140 is held in an open position against a side wall of lower spacer member 50.

Figure 4:
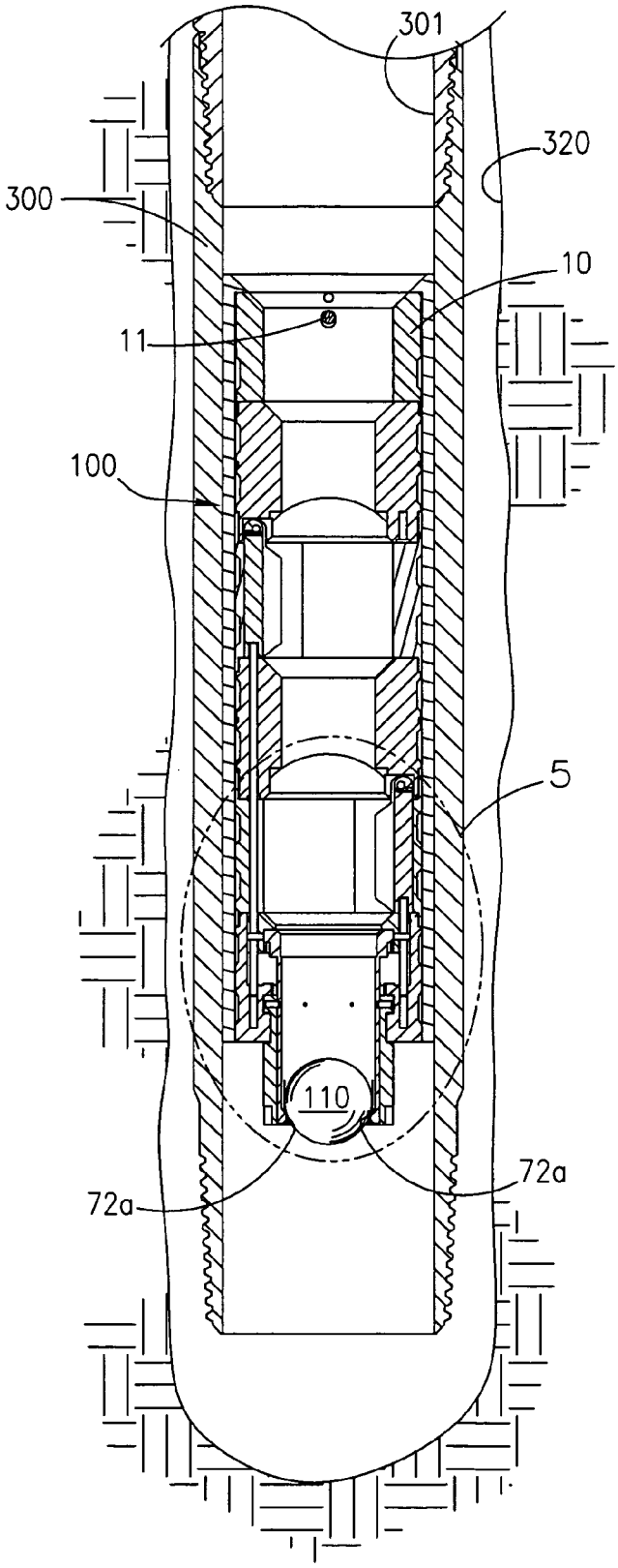
FIG. 4 depicts a side sectional view of the float assembly of the present invention installed in a wellbore with an actuation ball in a seated position and the valves of the present invention in an open position.

FIG. 4 depicts a side sectional view of float assembly 100 of the present invention installed in a wellbore 320 with actuation ball 110 in a seated position on the seat formed by cooperating collet dogs 72*a*. It is to be observed that floatable actuation ball 110 can be included within float assembly 100 and maintained within ball retaining sub 10 using retaining pin 11 as casing string 300 is run into wellbore 320. Alternatively, float assembly 100 can be run into wellbore 320 without retaining pin 11 and actuation ball 110. Once casing string 300 and float assembly 100 are at a desired position within wellbore 320, actuation ball 110 can be dropped, launched or otherwise placed into central bore 301 of casing string 300 and pumped downhole into float assembly 100 until it is ultimately received on the seat formed by cooperating collet dogs 72*a* of collets 72. The diameter of activation ball 110 and the seat formed by cooperating dogs 72*a* of collets 72 can be varied for different well conditions or operating parameters.

Figure 5:
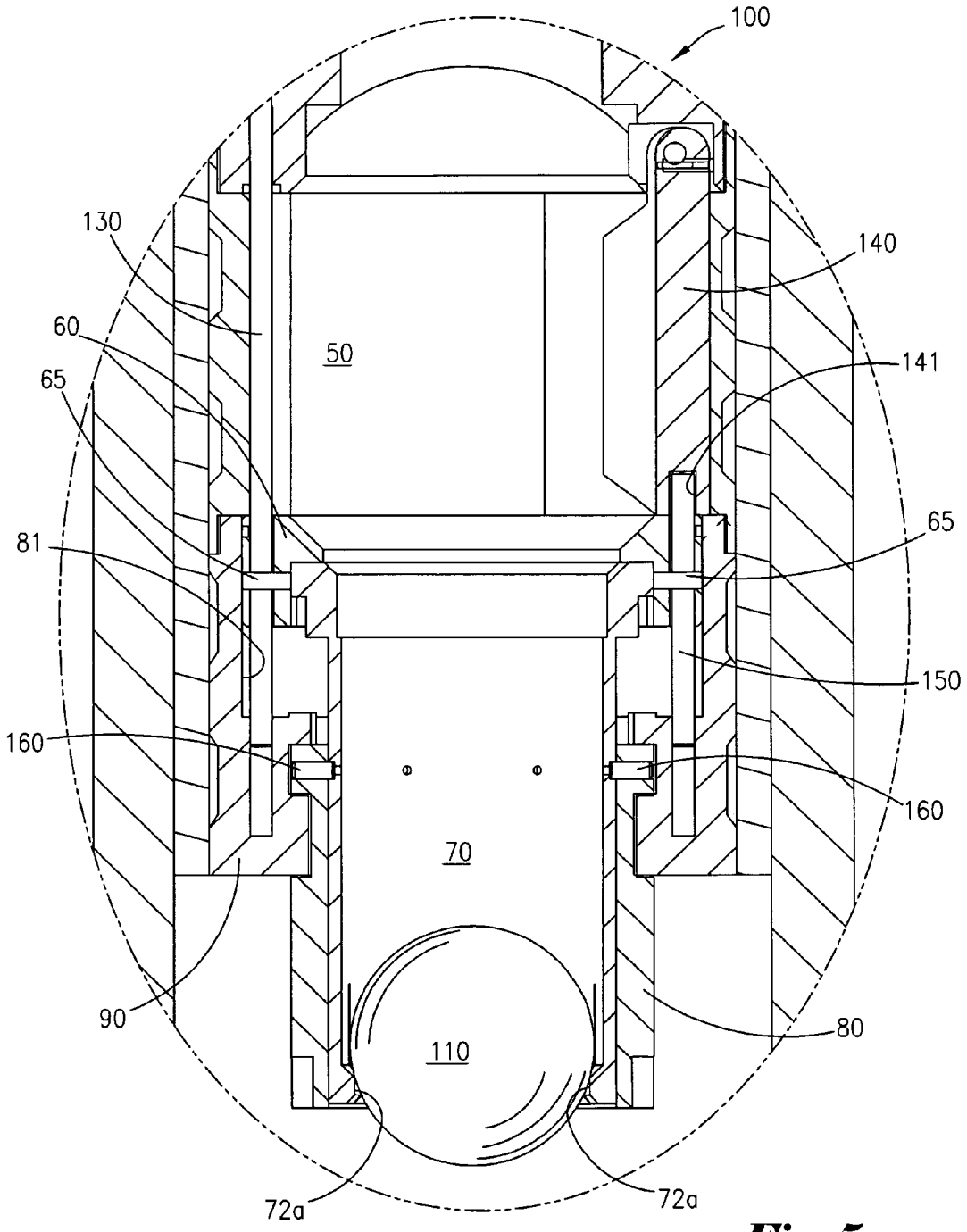
FIG. 5 depicts a detailed view of a highlighted section of the float assembly of the present invention depicted in FIG. 4 with an actuation ball in a seated position and the lower valve of the present invention in an open position.

FIG. 5 depicts a detailed view of a highlighted area 5 of float assembly 100 of the present invention depicted in FIG. 4, with actuation ball 110 in a seated position on the seat formed by cooperating collet dogs 72*a*. Ball seat member 70 remains secured against axial movement within central bore 81 of retaining sleeve 80 by shear pins 160. As such, lower locking rod 150 remains received within recess 141 in lower flapper 140, thereby preventing said lower flapper 140 from closing. In this position, lower flapper 140 is held in an open position against a side wall of lower spacer member 50. Although not shown in FIG. 5, the upper end of upper locking rod 130 is similarly slidably received within recess 121 in upper flapper 120, thereby preventing upper flapper 120 from closing. In this position, upper flapper 120 is also held in an open position against a side wall of upper spacer member 30.

Figure 6:
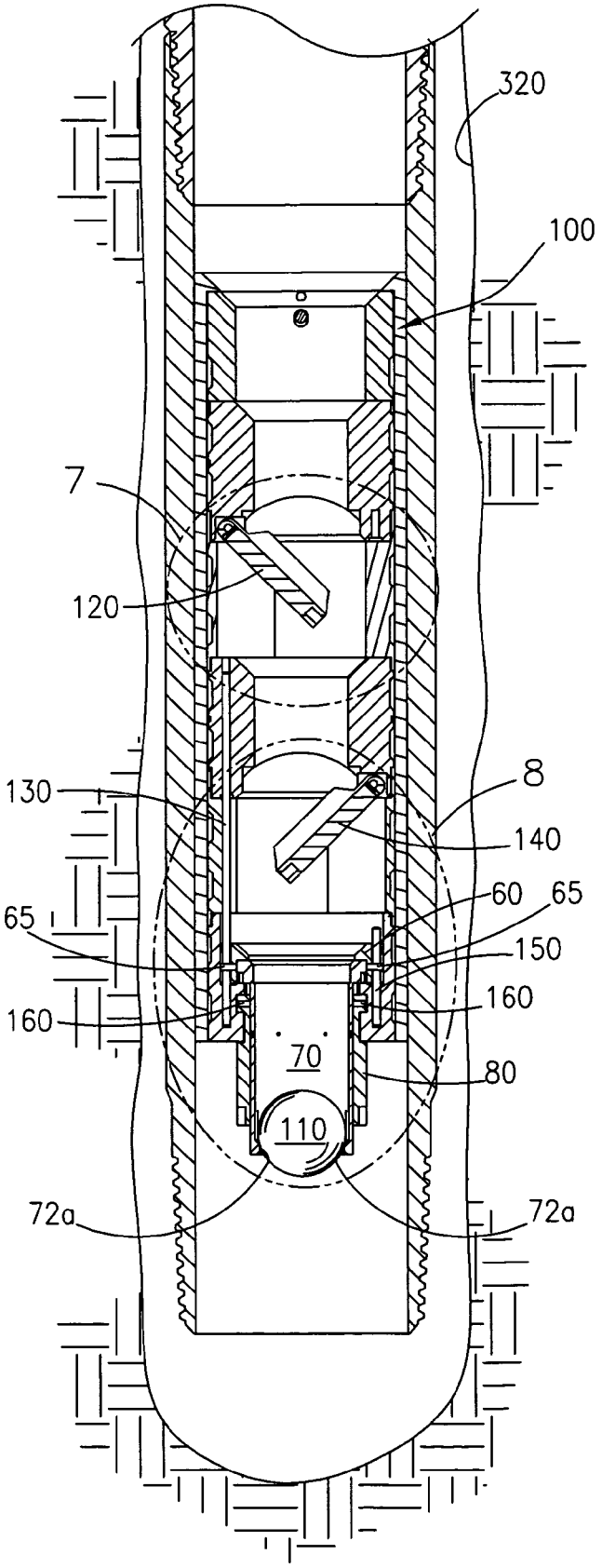
FIG. 6 depicts a side sectional view of the float assembly of the present invention installed in a wellbore with an actuation ball in a seated position and two flapper valves in a partially closed position.

FIG. 6 depicts a side sectional view of float assembly 100 of the present invention installed in wellbore 320 with actuation ball 110 in a seated position on cooperating collet dogs 72*a* of collets 72. As shown in the configuration depicted in FIG. 6, fluid pressure has been applied above actuation ball 110, causing axial (downward) force to act on actuation ball 110 and, in turn, ball seat member 70. When such force reaches a desired level, shear pins 160 (which are set to a predetermined force) shear, thereby permitting axial movement of ball seat member 70 within central bore 81 of retaining sleeve 80.

Downward movement of ball seat member 70 causes corresponding downward movement of collar 60 which, in turn, translates to downward movement of upper locking rod 130 and lower locking rod 150 (each of which are connected to said collar member 60 using rod retaining pins 65). As a result of such downward movement, the upper end of lower locking rod 150 disengages from recess 141 in lower flapper 140 while the upper end of upper locking rod 130 disengages from recess 121 in upper flapper 120.

Figure 7:
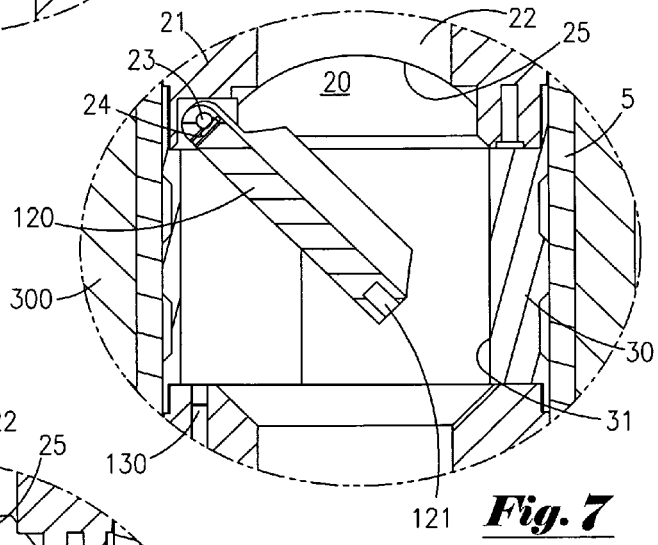
FIG. 7 depicts a detailed view of a highlighted section of the float assembly of the present invention depicted in FIG. 6 with the upper flapper in a partially closed position.

FIG. 7 depicts a detailed view of a highlighted area 7 of float assembly 100 depicted in FIG. 6 with upper flapper 120 in a partially closed position. As depicted in FIG. 7, the upper end of upper locking rod 130 has been disengaged from recess 121 in upper flapper 120. Without said upper locking rod 130 acting to resist the forces applied to upper flapper 120 by torsion spring 24, upper flapper 120 is permitted to rotate about upper hinge pin 23 and engage against flapper seat 25 and seal flow bore 22 of upper valve housing 21 against pressure from below said flapper 120.

Figure 8:
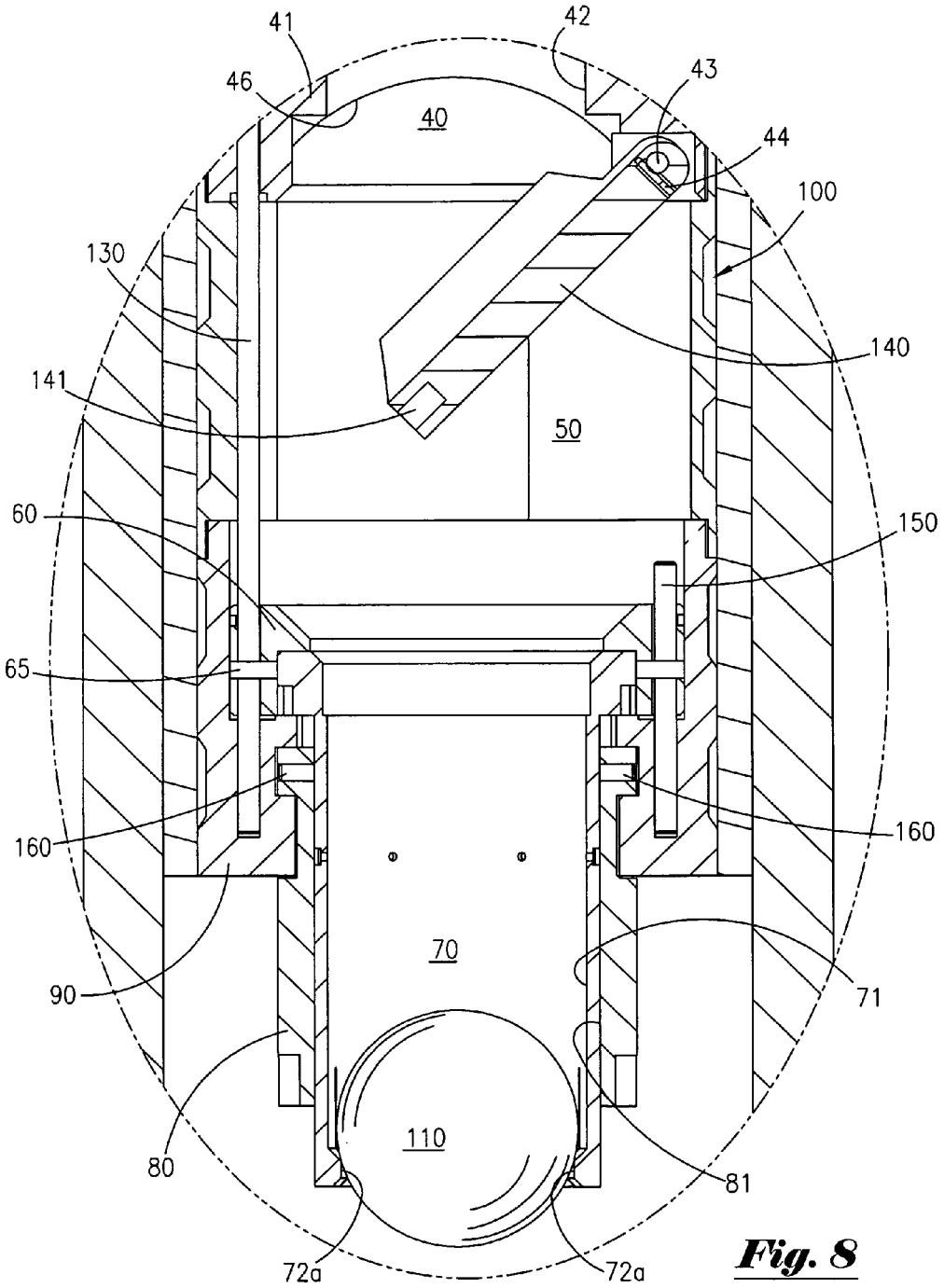
FIG. 8 depicts a detailed view of a highlighted section of the float assembly of the present invention depicted in FIG. 6 with an actuation ball in a seated position and the lower valve of the present invention in a partially closed position.

FIG. 8 depicts a detailed view of a highlighted area 8 of float assembly 100 of the present invention depicted in FIG. 6. Actuation ball 110 is received and seated on cooperating collet dogs 72*a* of collets 72. Fluid pressure applied above actuation ball 110 causes axial (downward) force to act on actuation ball 110 and, in turn, ball seat member 70. As such force reaches a desired level, shear pins 160 shear, thereby permitting axial movement of ball seat member 70 within central bore 81 of retaining sleeve 80. Such downward movement of ball seat member 70 causes corresponding downward movement of collar 60 and upper locking rod 130 and lower locking rod 150. As a result of such downward movement, the upper end of lower locking rod 150 disengages from recess 141 in lower flapper 140. Without said lower locking rod 150 acting to resist the forces applied to lower flapper 140 by torsion spring 44, lower flapper 140 is permitted to rotate about lower hinge pin 43 and engage against lower flapper seat 46 to seal central flow bore 42 of lower valve housing 41.

Figure 9:
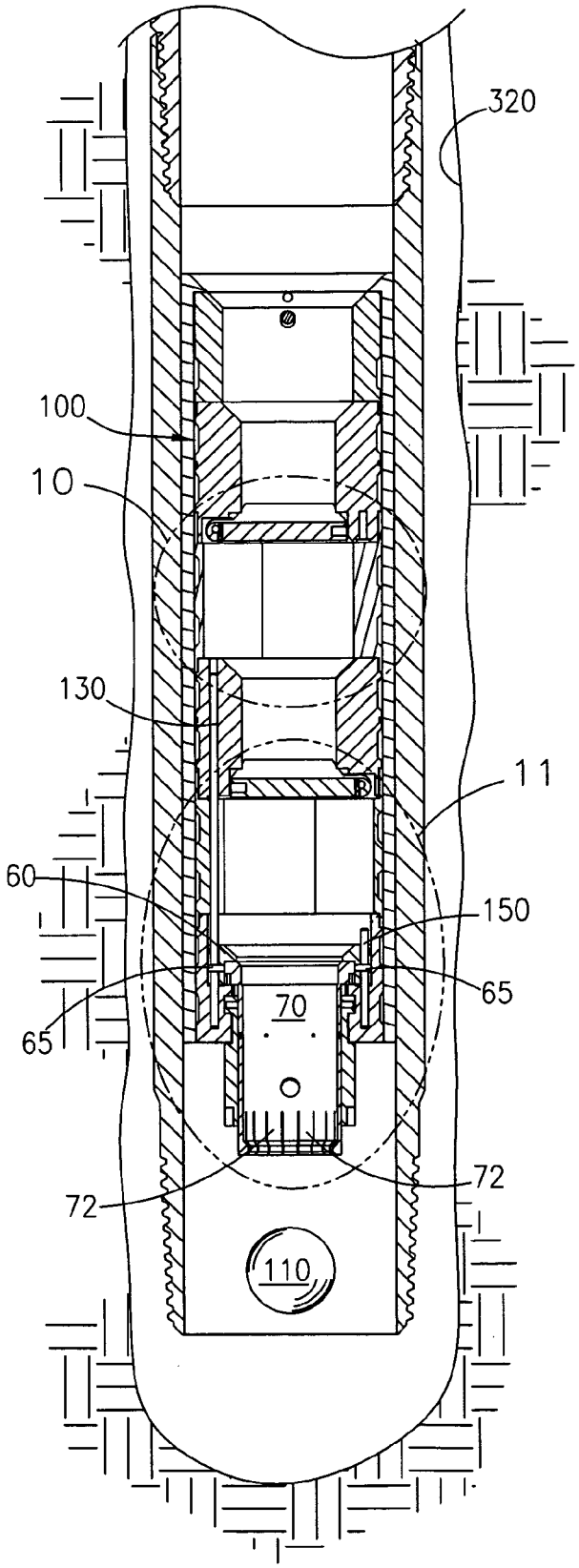
FIG. 9 depicts a side sectional view of the float assembly of the present invention installed in a wellbore with two flapper valves in a fully closed position.

FIG. 9 depicts a side sectional view of float assembly 100 of the present invention installed in wellbore 320. Fluid pressure has been applied above actuation ball 110, causing axial (downward) force to act on actuation ball 110 and, in turn, ball seat member 70. As depicted in FIGS. 6-8 above, axial movement of ball seat member 70 causes corresponding downward movement of collar 60 which, in turn, translates to downward movement of upper locking rod 130 and lower locking rod 150 (each of which are connected to collar member 60 using rod retaining pins 65). As such fluid pressure is increased, the downward force acting on actuation ball 110 also increases. Such downward force causes collets 72 to spread apart radially outward, thereby permitting actuation ball 110 to be expelled out the bottom of ball seat member 70, and out of casing string 300 and into wellbore 320 below.

Figure 10:
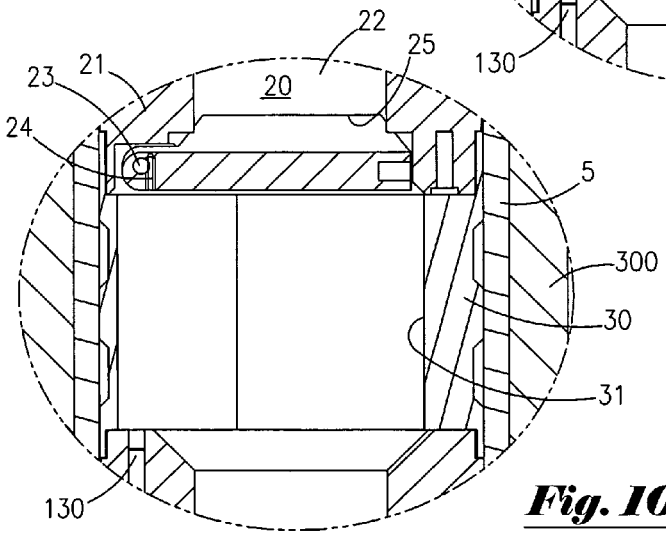
FIG. 10 depicts a detailed view of a highlighted section of the float assembly of the present invention depicted in FIG. 9 with the upper flapper in a fully closed position.

As shown in FIG. 10, without upper locking rod 130 acting to resist the forces applied to upper flapper 120 by torsion spring 24, upper flapper 120 is permitted to rotate about upper hinge pin 23, ultimately engaging and sealing against upper flapper 25 and sealing central flow bore 22 of upper valve housing 21 against pressure from below.

Figure 11:
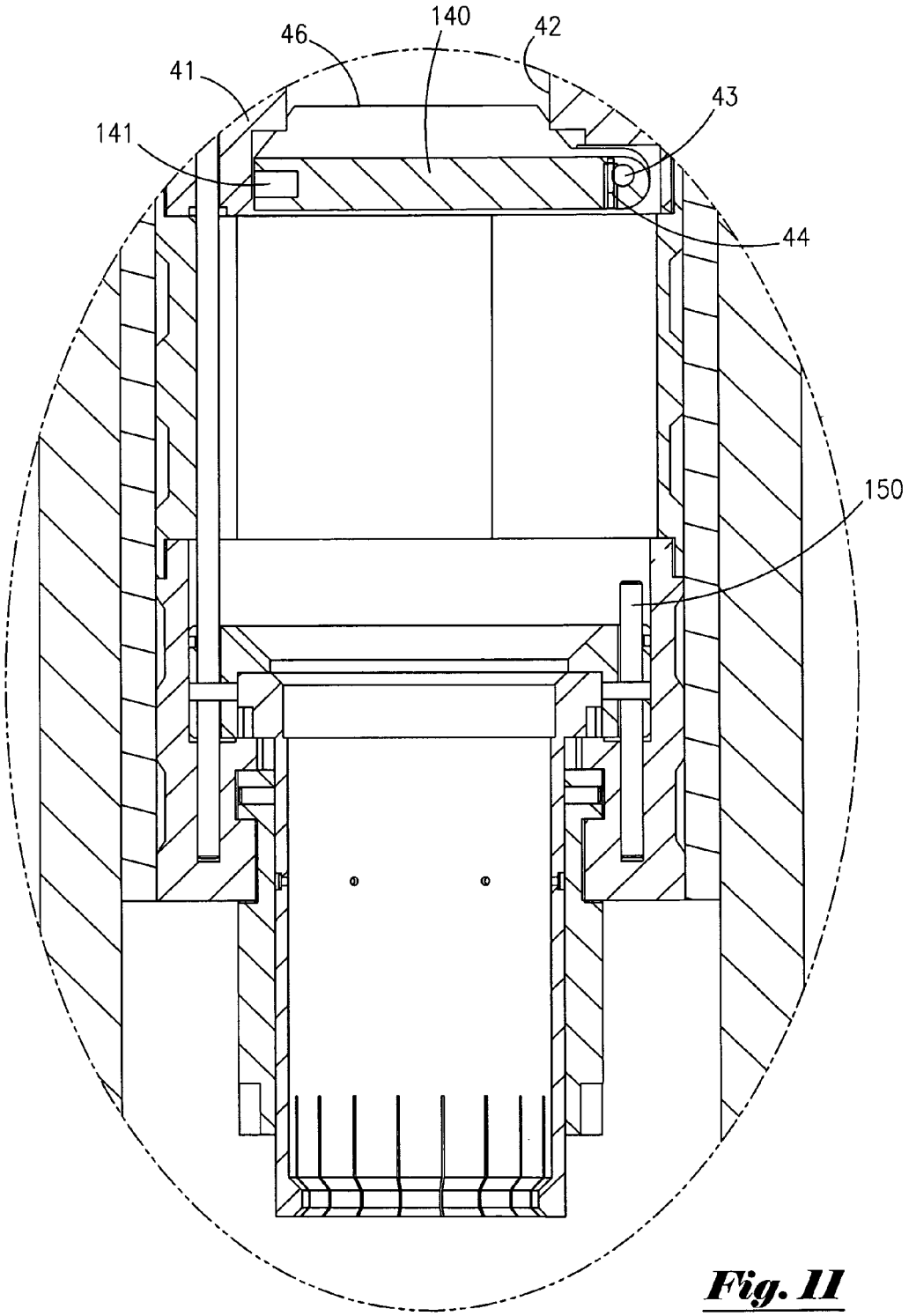
FIG. 11 depicts a detailed view of a highlighted section of the float assembly of the present invention depicted in FIG. 9 with the lower flapper in a fully closed position.

Similarly, as depicted in FIG. 11, without said lower locking rod 150 received within recess 141 of flapper 140 and acting to resist the forces applied to lower flapper 140 by torsion spring 44, lower flapper 140 is permitted to rotate about lower hinge pin 43, ultimately sealing against lower flapper seat 46 and sealing central flow bore 42 of lower valve housing 41 against pressure from below.

FIG. 12 depicts an exploded perspective view of float assembly 100 of the present invention comprising ball retaining sub 10, upper valve assembly 20, upper spacer member 30, lower valve assembly 40, lower spacer member 50, collar member 60, ball seat member 70, retaining sleeve 80 and bottom housing 90.

Ball retaining sub 10 has central bore 12 extending through said sub, as well as aligned transverse bores 13 extending through the side walls of ball retaining sub 10. Transverse bores 13 are aligned with each other and oriented substantially perpendicular to the longitudinal axis of central bore 12. After actuation ball 110 is installed in central bore 12, elongate retaining pin 11 can be installed in said transverse bores 13. In the preferred embodiment, said elongate retaining pin 11 substantially bisects cross-sectional area of central flow bore 12, and said retaining pin 11 will prevent floatable actuation ball 110 from floating out of float assembly 100 as said assembly is being lowered into a wellbore. Sealing ring 14 can be installed between ball retaining sub 10 and upper valve assembly; in the preferred embodiment, said sealing ring 14 can be made of rubber or other elastomeric sealing material.

Upper valve assembly 20 comprises upper valve housing 21 having central flow bore 22 extending therethrough. Upper flapper 120 is pivotally connected to upper valve housing 21 using upper hinge pin 23. Torsion spring 24 acts to bias upper flapper 120 toward the closed position (that is, a position in which flapper 120 rotates about upper hinge pin 23 and seals central flow bore 22 of upper valve housing 21). Upper flapper sealing element 122 can form a fluid pressure seal when flapper 120 is closed, and can be made of rubber or other elastomeric sealing material Upper spacer member 30 having central bore 31 is situated below upper valve assembly 20. When upper flapper 120 is in the open position, said upper flapper 120 extends into central bore 31 of upper spacer member 30.

Lower valve assembly 40, connected beneath upper spacer member 30, comprises lower valve housing 41 having central flow bore 42 extending therethrough. Lower flapper 140 is pivotally connected to lower valve housing 41 using lower hinge pin 43. Torsion spring 44 acts to bias lower flapper 140 toward the closed position (that is, a position in which flapper 140 rotates about lower hinge pin 43 and seals central flow bore 42 of lower valve housing 41). Lower flapper sealing element 142 can form a fluid pressure seal when flapper 140 is closed, and can be made of rubber or other elastomeric sealing material.

Lower spacer member 50 having central bore 51 is situated below lower valve assembly 40. When lower flapper 140 is in the open position, said lower flapper 140 extends into central bore 51 of lower spacer member 50.

Bottom housing 90 has central bore 91 extending therethrough. Retaining sleeve 80, having central bore 81, is connected to bottom housing 90. Collar member 60 has central bore 61 extending therethrough, and is slidably received within central bore 91 of bottom housing 90. Ball seat member 70 having central bore 71 is connected to collar member 60, and is concentrically and slidably received within central bore 81 of retaining member 80.

Ball seat member 70 is secured against axial movement within central bore 81 of retaining sleeve 80 using shear pins 160. Ball seat member 70 has a plurality of collets 72 disposed at its lower end. Said collets 72 have cooperating dogs 72*a* that extend into central bore 71 of ball seat member 70, and cooperatively act to form a "seat" by restricting the internal diameter of said central bore 71.

Upper locking rod 130 has transverse bore 131, while lower locking rod 150 has transverse bore 151. In the preferred embodiment, said rod retaining pins 65 extend through aligned transverse bores in collar member 60, as well as aligned bores 131 and 151 of said upper and lower locking rods 130 and 150, respectively. Although not depicted in FIG. 12, upper locking rod 130 is slidably received within aligned rod bores 45 and 55 of lower valve assembly 40 and lower spacer member 50, respectively. Said rod bores 45 and 55 are oriented substantially parallel to the longitudinal axes of central flow bore 43 of lower valve assembly 40 and central bore of lower spacer member 50.

Figure 13:
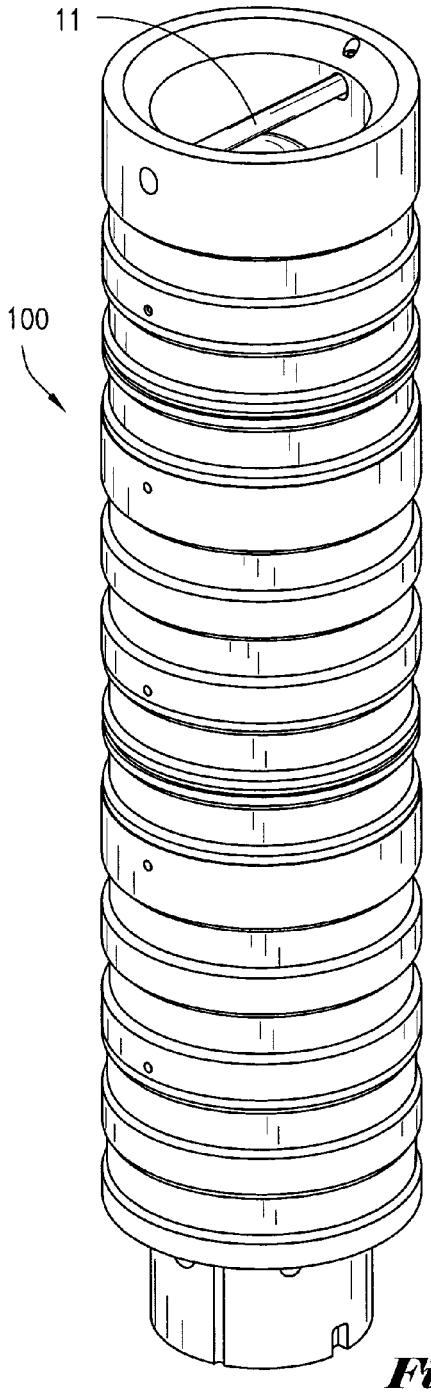
FIG. 13 depicts a perspective view of the float assembly of the present invention.
Figure 14:
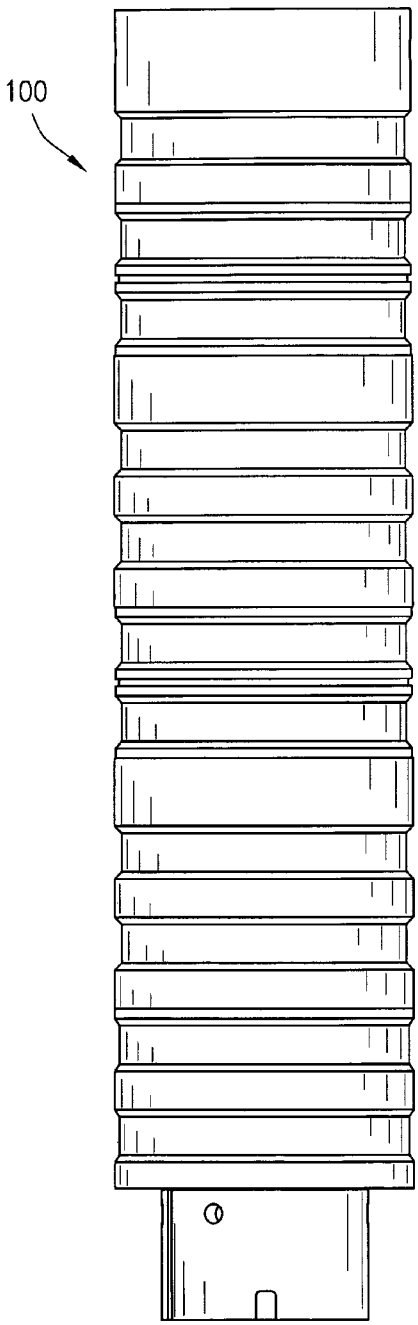
FIG. 14 depicts a side view of a float assembly of the present invention.

FIG. 13 depicts a perspective view of assembled float assembly 100 of the present invention, while FIG. 14 depicts a side view of said assembled float assembly 100 of the present invention. In the preferred embodiment of the present invention, float assembly 100 is concentrically disposed within an external sleeve member (such as external sleeve member 5 in FIG. 1, not shown in FIG. 14). Said external sleeve 5, together with float assembly 100, is received within a casing string (such as casing string 300 in FIG. 1).

Figure 15:
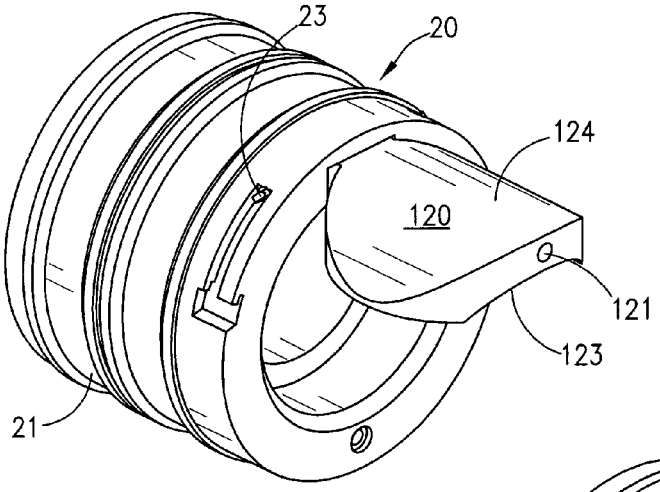
FIG. 15 depicts a perspective view of a valve assembly of the present invention in an open position.
Figure 16:
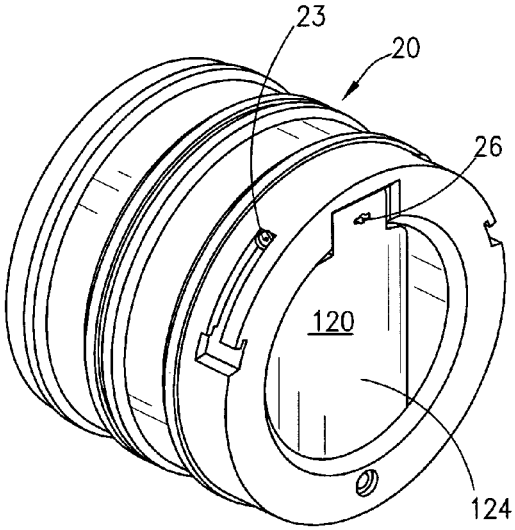
FIG. 16 depicts a perspective view of a valve assembly of the present invention in a closed position

FIG. 15 depicts a perspective view of upper valve assembly 20 of the present invention with flapper 120 in a fully open position. In the preferred embodiment of the present invention, upper valve housing 21 and flapper 120 are manufactured from high-temperature resins compression molded around a carbon- or glass-reinforced framework for added strength. Valve housing 21 also has spring slot 26 for receiving torsion spring 24. Flapper 120 has end recess 121, as well as a curved profile with substantially concave sealing surface 123 and substantially convex non-sealing (back) surface 124. FIG. 16 depicts a perspective view of upper valve assembly 20 of the present invention with flapper 120 in a fully closed position.

Figure 17:
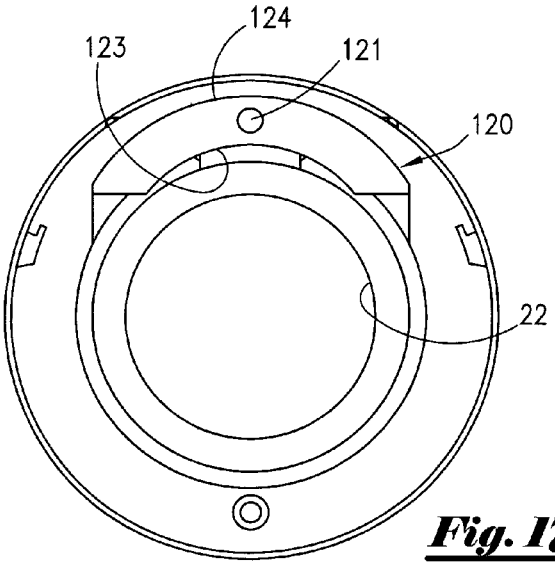
FIG. 17 depicts an end view of a valve assembly of the present invention with a flapper in an open position.

FIG. 17 depicts an end view of upper valve assembly 20 of the present invention with flapper 120 in a fully open position. The curved shape of flapper 120 (and 140) and the positioning of said flappers in the open position, together with the actuation mechanism described herein, ensure that components do not extend into the central flow bore of float assembly 100. As a result, this allows the largest-possible inner diameter (ID) to be maintained when valve assemblies 20 and 40 are in the open position (that is, when flappers 120 and 140 are open), resulting in higher auto-filling flow rates and maximum debris tolerance through the central bore of float assembly 100. Additionally, the curved design of flappers 120 and 140 (including, without limitation, substantially convex non-sealing surfaces of said flappers) yield significantly higher pressure ratings for the valves of the present invention compared to prior art valve assemblies.

Figure 18:
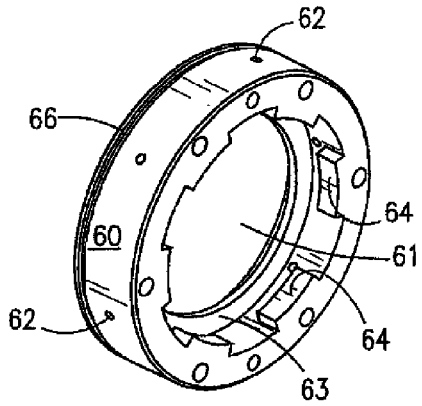
FIG. 18 depicts a perspective view of a collar member of the present invention.

FIG. 18 depicts a side perspective view of collar member 60 of the present invention. Collar member 60 has a plurality of transverse bores 62 for receiving rod retaining pins 65, as well as inner shoulder 63 and inner dogs 64. Collar member 60 can also have a sealing member 66 around its outer circumference.

Figure 19:
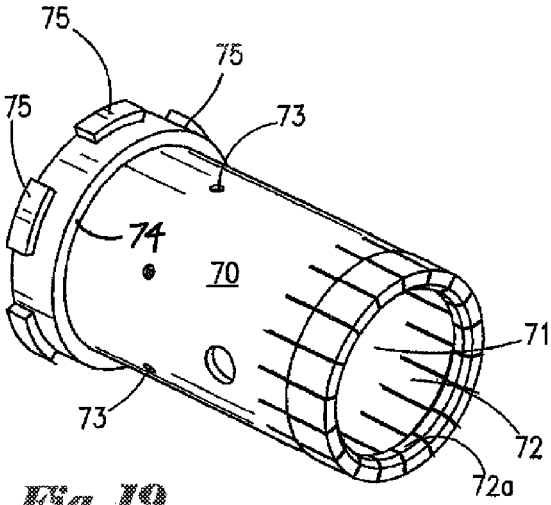
FIG. 19 depicts a perspective view of a ball seat member of the present invention.

FIG. 19 depicts a side perspective view of ball seat member 70 of the present invention. Ball seat member 70 is generally cylindrical in shape, and has a plurality of collets 72 disposed at its lower end. Said collets 72 have dogs 72*a* that extend into central bore 71 of ball seat member 70, and cooperatively act to form a "seat" by restricting the internal diameter of said central bore 71. Ball seat member 70 also has a plurality of transverse bores 73 for receiving shear pins 160, as well upper shoulder 74 and dogs 75 extending radially outward from said ball seat member 70.

Figure 20:
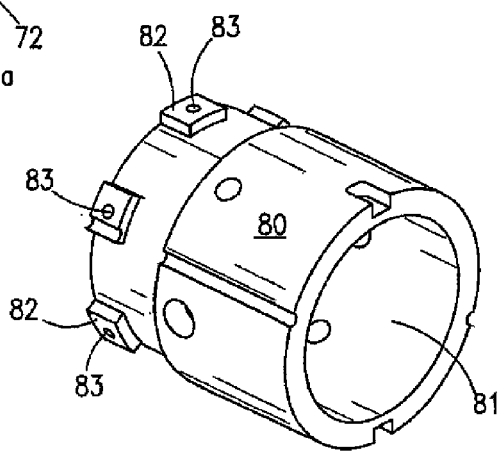
FIG. 20 depicts a perspective view of a retaining sleeve of the present invention.
Figure 21:
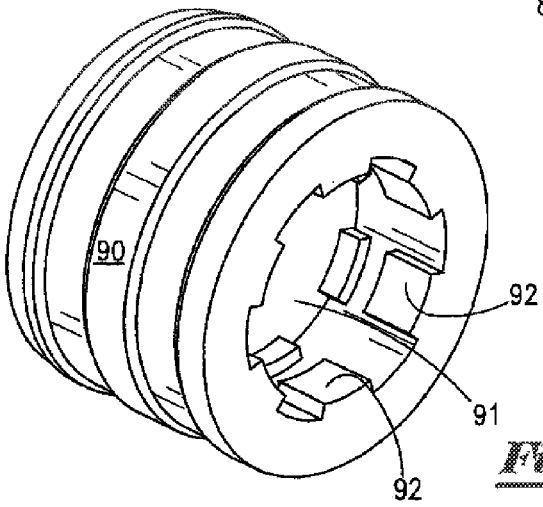
FIG. 21 depicts a perspective view of a bottom housing of the present invention.

FIG. 20 depicts a side perspective view of retaining sleeve member 80 of the present invention. Retaining sleeve member has central bore 81, dogs 82 extending radially outward, and a plurality of transverse bores 83 extending through said retaining sleeve member 80 for receiving shear pins 160. FIG. 21 depicts a side perspective view of bottom housing 90 of the present invention. Bottom housing 90 is substantially cylindrical and has central bore 91 and inner dogs 92.

OPERATION OF A PREFERRED EMBODIMENT

In the preferred embodiment, the valves of float assembly 100 are selectively actuated using a floatable actuation ball 110 (by way of illustration, but not limitation, constructed of phenolic material) that can beneficially engage against a corresponding colletted ball seat formed by cooperating collet dogs 72*a* positioned below said valves. When flow rate is established through the system, said actuation ball is received on said seat, forming a substantially total flow restriction through central flow bore of said float assembly 100.

When desired, fluid pressure can then be increased above said seated ball 110. At a predetermined, specified pressure, sufficient force will act upon ball 100 and seat member 70, which is in turn translated to composite shear pin(s) 160 causing such pin(s) to shear, thereby allowing ball seat member 70 to travel downward, away from said valves. Such axial movement of seat member 70 actuates the mechanism holding flappers 120 and 140 open, thereby allowing said flappers to close. As pressure continues to increase above actuation ball 110, collets 72 of ball seat member 70 spread radially apart, allowing actuation ball 110 to pass through said opened collets 72 and to be expelled from float assembly 100 into wellbore 320 below. The colletted ball seat of the present invention permits changing of both the number of composite shear pins (thereby permitting adjustment of the activation pressure) and flow port size (thereby permitting adjustment of the activation flow rate) of the system.

According to one particularly advantageous embodiment of the present invention, the components of the present invention (including, without limitation, flappers 120 and 140, as well as valve bodies 21 and 41, hinge pins, springs and shear pins) are manufactured from high-temperature composite materials. Said composite materials can include resins compression molded around a carbon- or glass-reinforced framework for added strength. The curved profile of flappers 120 and 140, and the internal actuation mechanism, allows the largest-possible inner diameter (ID) to be maintained through central flow bores of the present invention when the valves are in the open position; such lack of restriction results in higher auto-filling flow rates and maximum debris tolerance through the central bore of said float assembly. Additionally, the configuration of valve mechanisms including, without limitation the shape of curved flappers 120 and 140, including the convex non-sealing surfaces, yield significantly higher pressure ratings for the valves of the present invention compared to valves of existing prior art assemblies.

In the preferred embodiment, valve springs 24 and 44 are carbon- or glass-reinforced single torsion-type springs. Hinge pins 23 and 43, as well as other activation mechanism components, are comprised of carbon- or glass-reinforced rods for high tensile and shear strength. Colletted ball seat member 70 is also manufactured as a high-temperature mandrel-wrapped reinforced composite. Shear pins 160 are ultrafine-grain graphite or uniform-resin composite, which are not affected by temperature like conventional metallic shear pins. Actuation ball 110 is beneficially constructed from a low-density phenolic material, which floats in most wellbore fluids, keeping the ball away from ball seat member 70 until desired, thereby reducing the likelihood of packing-off the central flow bore of the assembly with cuttings or other wellbore debris. All of said components can be easily drillable, non-metallic components.

Due to the configuration of the components of the present invention, and particularly collar member 60, ball seat member 70, retaining sleeve 80 and bottom housing 90, said components can be easily and quickly removed, repaired and/or replaced without specialized tools, including in the field. By way of illustration, but not limitation, ball seat member 70 can be interchanged in order to change the strength of collet members 70, thereby affecting the functioning pressures of the tool. This feature makes the float assembly of the present invention significantly more versatile than other existing prior art float assemblies.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A float assembly comprising:

a. an upper valve assembly having a body, a substantially cylindrical central flow bore extending therethrough and a flapper hingeably connected to said body;

b. a lower valve assembly having a body, a substantially cylindrical central flow bore extending therethrough aligned with the central flow bore of said upper valve assembly, and a flapper hingeably connected to said body;

c. a seat member disposed below said lower valve assembly, wherein said seat member travels in a direction parallel to the longitudinal axis of said aligned central flow bores;

d. a first retaining member having a first end and a second end, wherein said first end is connected to said seat member, and said second end is releasably joined with the flapper of said upper valve assembly when said flapper is in an open position; and e. a second retaining member having a first end and a second end, wherein said first end is connected to said seat member, and said second end is releasably joined with the flapper of said lower valve assembly when said flapper is in an open position.

2. The float assembly of claim 1, further comprising an actuation ball.

3. The float assembly of claim 2, wherein said actuation ball is floatable.

4. The float assembly of claim 3, wherein said actuation ball is constructed of a low-density phenolic material.

5. The float assembly of claim 3, wherein said actuation ball is retained within said float assembly offset from the central axis of said aligned central flow bores.

6. The float assembly of claim 1, wherein said valve assemblies are constructed of non-metallic material.

7. The float assembly of claim 1, wherein said flappers are constructed of non-metallic material.

8. The float assembly of claim 1, wherein said flappers each comprise a sealing surface and a non-sealing surface, and said non-sealing surface has a substantially convex shape.

9. The float assembly of claim 1, wherein said flappers do not extend into said aligned central flow bores of said upper and lower valve assemblies when said flappers are in an open position.

10. The float assembly of claim 1, wherein the hinge connection of said flapper of said upper valve assembly is out of phase with the hinge connection of said flapper of said lower valve assembly.

11. The float assembly of claim 10, wherein said hinge connections are phased 180 degrees relative to one another.

12. The float assembly of claim 1, wherein said seat member further comprises a substantially cylindrical body having a central flow bore extending therethrough, and a plurality of cooperating collets defining said seat.

13. The float assembly of claim 1, further comprising a ball retaining member comprising:

a. a substantially cylindrical housing having a central flow bore extending therethrough;

b. a first transverse bore extending through said cylindrical housing;

c. a second transverse bore extending though said cylindrical housing, and in alignment with said first transverse bore; and d. an elongate member extending through said first and second transverse bores across said central flow bore.

14. The float assembly of claim 13, wherein said elongate member substantially bisects said central flow bore of said substantially cylindrical housing.

* * * * *